US008906061B2

(12) United States Patent
Boughalem

(10) Patent No.: US 8,906,061 B2
(45) Date of Patent: Dec. 9, 2014

(54) HYGIENIC PACIFIER

(75) Inventor: El-Miloud Boughalem, Ballainvilliers (FR)

(73) Assignee: Idea' Inov SAS, Paris (FR)

( * ) Notice: Subject to any disclaimer, the term of this patent is extended or adjusted under 35 U.S.C. 154(b) by 659 days.

(21) Appl. No.: 13/125,637

(22) PCT Filed: Oct. 8, 2009

(86) PCT No.: PCT/FR2009/051926

§ 371 (c)(1),
(2), (4) Date: Aug. 11, 2011

(87) PCT Pub. No.: WO2010/046577

PCT Pub. Date: Apr. 29, 2010

(65) Prior Publication Data

US 2011/0288585 A1 Nov. 24, 2011

(30) Foreign Application Priority Data

Oct. 22, 2008 (FR) ..... 08 57169

(51) Int. Cl.
*A61J 17/00* (2006.01)

(52) U.S. Cl.
CPC ..... *A61J 17/00* (2013.01); *A61J 2017/008* (2013.01)
USPC ..... 606/234

(58) Field of Classification Search
CPC ..... A61J 17/00; A61J 2017/008
USPC ..... 606/234–236; D24/194–196; 206/438
See application file for complete search history.

(56) References Cited

U.S. PATENT DOCUMENTS

| | | | | |
|---|---|---|---|---|
| 4,819,641 | A * | 4/1989 | Russell et al. | 606/234 |
| 2006/0135997 | A1 | 6/2006 | Carmona | |
| 2006/0226044 | A1 | 10/2006 | Lobl | |

FOREIGN PATENT DOCUMENTS

| | | | |
|---|---|---|---|
| DE | 37 22 195 | A1 | 1/1989 |
| DE | 40 05 379 | C1 | 6/1991 |
| DE | 299 01 270 | U1 | 5/1999 |
| DE | 202 03 043 | U1 | 6/2002 |
| GB | 2355410 | A | 4/2001 |
| GB | 2384191 | A | 7/2003 |

OTHER PUBLICATIONS

International Search Report, dated Jan. 28, 2010, in PCT/FR2009/051926.
French Search Report, dated Jun. 3, 2009, in FR 0857169.

* cited by examiner

*Primary Examiner* — Julian W Woo
(74) *Attorney, Agent, or Firm* — Young & Thompson

(57) ABSTRACT

A device (1) for protecting a pacifier (2) includes: —a housing (3) for the pacifier, the pacifier having an external position where the pacifier is outside of the housing, the pacifier having an internal position where the pacifier is situated inside the housing; —an orifice (6) allowing the pacifier (2) to move from its internal position to its external position and from its external position to its internal position; and —elements (4, 40) for applying a return force (5) to the pacifier, the return force drawing the pacifier from its external position to its internal position. A method employed in this device is described. The pacifier is thus protected from dirt, germs and microbes and therefore the hygiene of the pacifier is improved.

36 Claims, 7 Drawing Sheets

HYGIENIC PACIFIER

TECHNICAL FIELD

Figure 1:
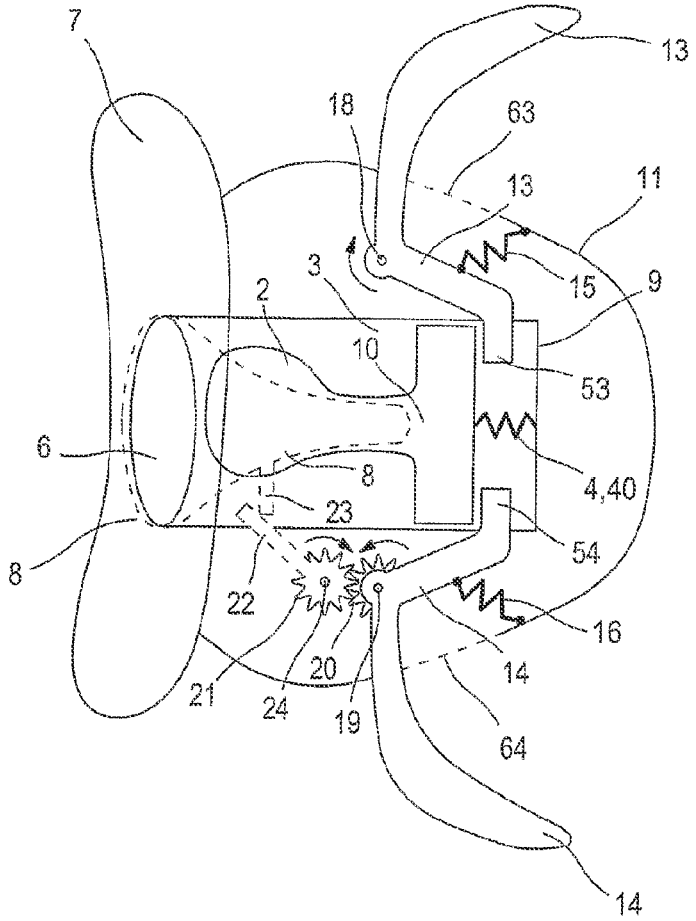

The present invention relates to a device for protecting a pacifier, and a method implemented by this device. In this document, the words pacifier and dummy will be used interchangeably. A pacifier or dummy is an object typically made of rubber, silicone or latex that is given to a baby or to a young child to suck, and which makes it possible to calm its need to suckle.

STATE OF THE ART

The advantages and drawbacks of a pacifier are well known from the state of the art.

The main advantage is that a pacifier makes it possible to calm a young child's need to suckle. Thus, the pacifier consoles and comforts the child, and makes it possible to avoid crying.

One of the drawbacks of the pacifier is that it can lead to deformation of the child's palate and alteration of growth of the child's teeth.

Another chief concern for the child's parents is the cleanliness of the pacifier. As soon as the pacifier escapes from the child's mouth and falls, the pacifier becomes soiled and gets covered with dirt, germs and microbes.

The purpose of the present invention is to propose a device and a method making it possible to improve the protection of a pacifier against dirt, in order to thus improve the hygiene of this pacifier.

DISCLOSURE OF THE INVENTION

This objective is achieved with a device for protecting a pacifier, characterized in that it comprises:

a housing for the pacifier, the pacifier having an external position in which said pacifier is situated outside the housing, the pacifier having an internal position in which said pacifier is situated inside the housing, an orifice allowing the pacifier to pass from its internal position to its external position and from its external position to its internal position, and means for exerting a return force on the pacifier, the return force pulling the pacifier from its external position to its internal position.

The means for exerting a return force are preferably arranged to pull the pacifier so that the device cannot remain in a configuration in which the pacifier is in its external position without user intervention.

Preferentially, in its external position the pacifier is situated completely outside the housing, and in its internal position the pacifier is situated completely inside the housing.

The device according to the invention can also comprise means for closing the orifice when the pacifier is in its internal position. The closing means can comprise a removable flap. The device according to the invention can also comprise means for coupling the closing of the orifice by the closing means with the passing of the pacifier from its external position to its internal position by the return means. The device according to the invention can also comprise means for actuating the passing of the pacifier from its internal position to its external position. The actuating means are preferably provided for manually actuating the passing of the pacifier from its internal position to its external position. The actuating means are preferably arranged to push the pacifier in a direction opposite to the return force. The actuating means can comprise at least one lever arranged to push the pacifier in a direction opposite to the return force. The actuating means can comprise a deformable pocket a first part of which is integral with the pacifier and a second emerging part of which is accessible to a user. The means for exerting a return force can comprise this deformable pocket.

The device according to the invention can also comprise means for coupling the passing of the pacifier from its internal position to its external position by the actuating means with the opening of the orifice.

The means for exerting a return force can comprise a spring and/or a space in which a vacuum is created and/or the deformable pocket.

The device according to the invention can also comprise a support surface for a mouth, said surface surrounding the orifice.

The device according to the invention is preferably arranged to remain inert when the pacifier is in its internal position.

The housing can be comprised in a cylindrical tube, the orifice being situated at one of the two ends of this cylindrical tube.

The housing and the return means can be situated inside a casing. The pacifier can be arranged to be able to move with respect to the casing, and the orifice and the housing can be integral with the casing. The support surface for the mouth can be situated outside the casing and can be integral with the casing. The orifice can be formed on one wall of the casing.

The device according to the invention can also comprise braking means arranged to reduce the return force when the pacifier is in its external position without cancelling out this return force. The braking means can comprise at least one protuberance integral with the pacifier and/or at least one protuberance integral with a body or tube inside which the pacifier is arranged to move between its internal position and its external position.

The device according to the invention can also comprise a stretchable membrane integral with the pacifier and with a rim of the orifice so as to block off the orifice. The rim of the orifice, the membrane and the pacifier can be integral so that the membrane and the pacifier block off the orifice with no gap between the rim of the orifice and the membrane and with no gap between the membrane and the pacifier and so that, when the pacifier is in the external position, the pacifier is not covered by the membrane. In another variant, the rim of the orifice and the membrane can be integral so that the membrane by itself blocks off the orifice with no gap between the rim of the orifice and the membrane, and so that when the pacifier is in the external position, the pacifier is covered by the membrane.

According to yet another aspect of the invention, a method is proposed for protecting a pacifier within a housing, implemented in a device according to the invention, the pacifier having an external position in which said pacifier is situated outside the housing, the pacifier having an internal position in which said pacifier is situated inside the housing, the device comprising an orifice allowing the pacifier to pass from its internal position to its external position and from its external position to its internal position, said method being characterized in that it comprises the exertion of a return force on the pacifier, the return force pulling the pacifier from its external position to its internal position.

The return force can pull the pacifier so that the device cannot remain in a configuration in which the pacifier is in its external position without user intervention.

The orifice can be surrounded by a support surface for a mouth.

The method according to the invention can also comprise the closing of the orifice when the pacifier is in its internal position. The method according to the invention can also comprise the coupling of the closing of the orifice with the passing of the pacifier from its external position to its internal position, this passing being due to the exertion of the return force.

The method according to the invention can also comprise actuation for the passing of the pacifier from its internal position to its external position. The actuation for the passing of the pacifier from its internal position to its external position is preferably manual actuation. The actuation for the passing of the pacifier from its internal position to its external position preferably pushes the pacifier in a direction opposite to the return force. By manual actuation is meant actuation by a user, who typically actuates a lever, a spring, a small motor or any other device. The actuation (preferably manual) can comprise the actuation of a lever in order to push the pacifier in a direction opposite to the return force. The actuation (preferably manual) can also comprise the actuation of a deformable pocket a first part of which is integral with the pacifier and an emerging second part of which is accessible to a user, said actuation comprising the exertion of pressure on the second part of the pocket. The return force can be exerted by the deformable pocket.

The method according to the invention can also comprise the coupling of the passing of the pacifier from its internal position to its external position with the opening of the orifice.

The method according to the invention can also comprise the reduction, by braking means and preferably by the braking means previously described or described hereafter with reference to the figures, of the return force when the pacifier is in its external position without cancelling out this return force.

The method according to the invention can also comprise the blocking off of the orifice by a stretchable membrane integral with a rim of the orifice and the pacifier, preferably by the membrane previously described or described hereafter with reference to the figures.

DESCRIPTION OF THE FIGURES AND EMBODIMENTS

Figure 2:
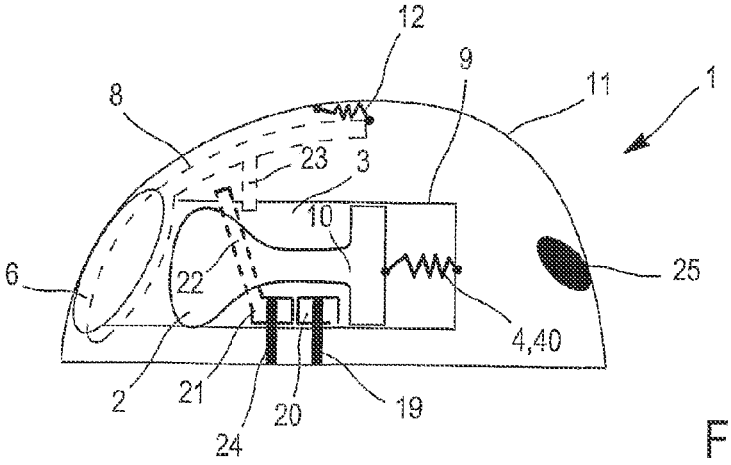
Figure 3:
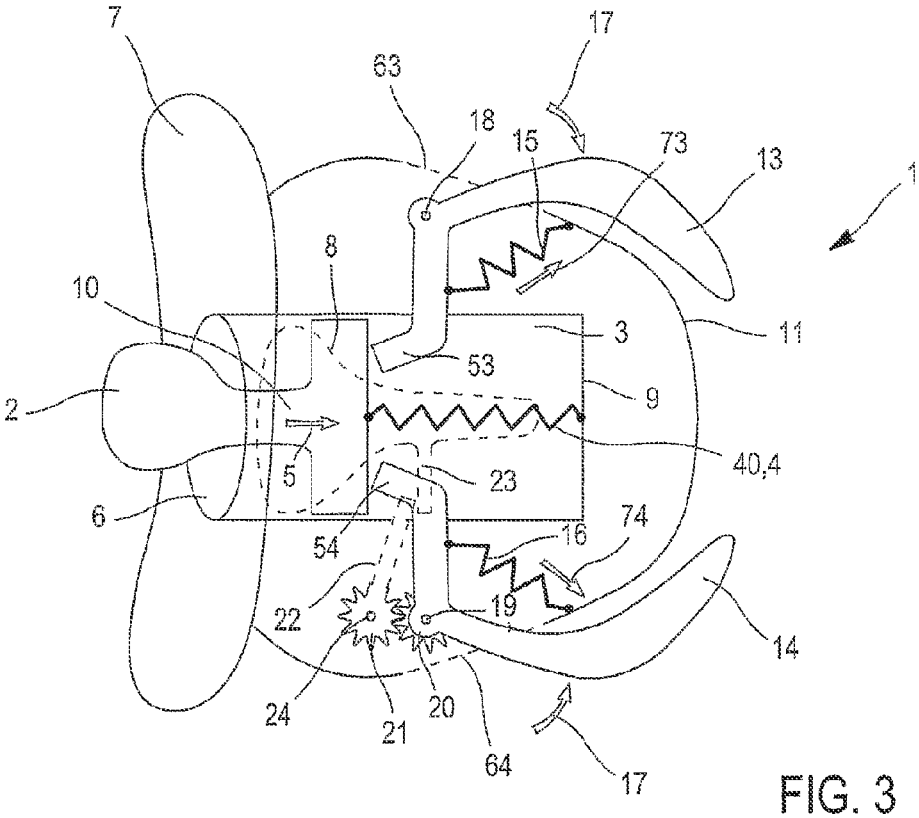
Figure 4:
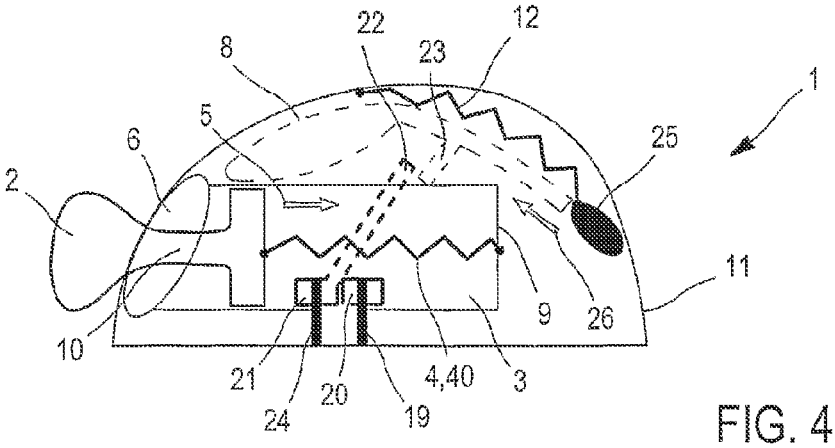
Figure 5:
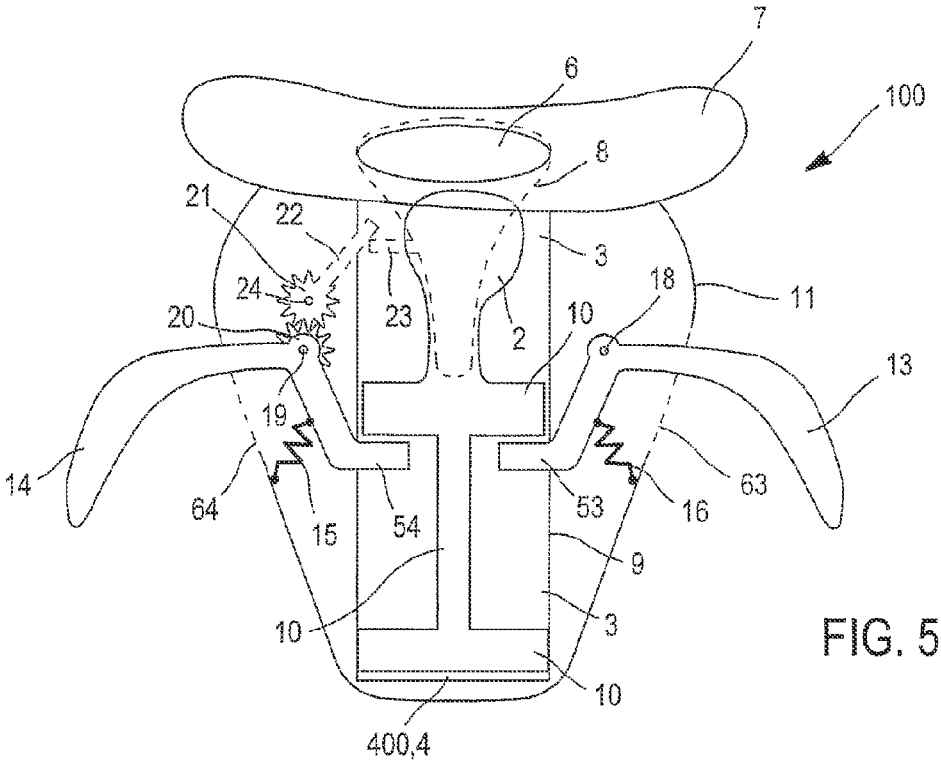
Figure 6:
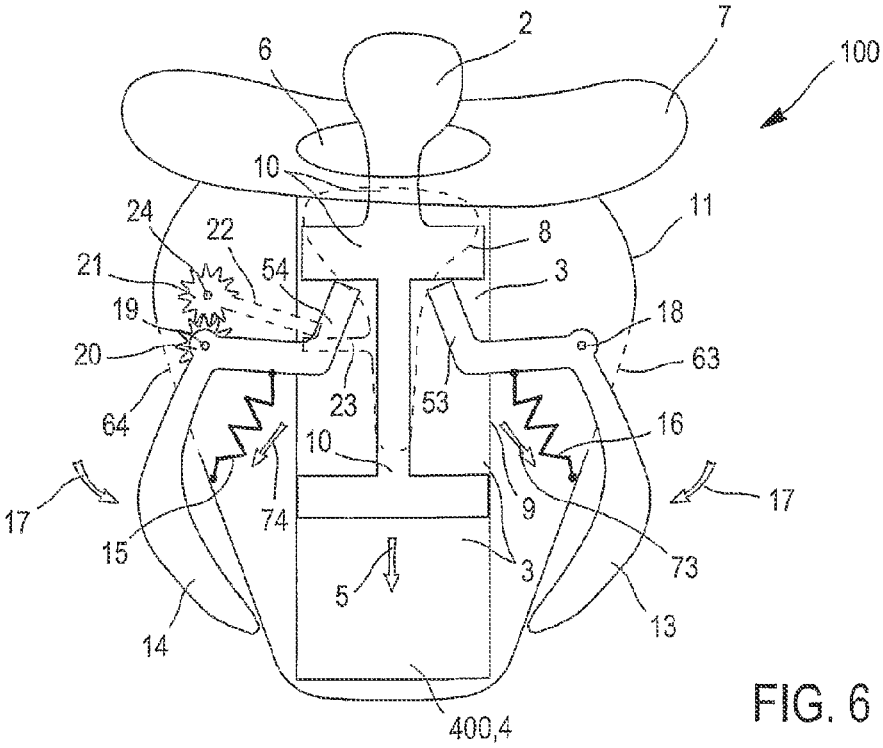
Figure 7:
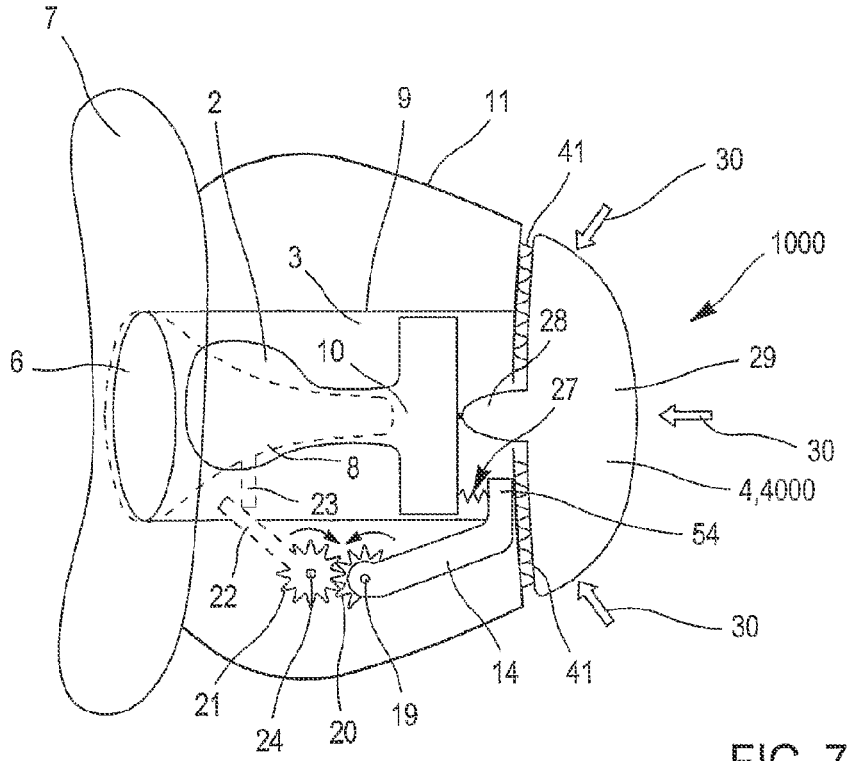
Figure 8:
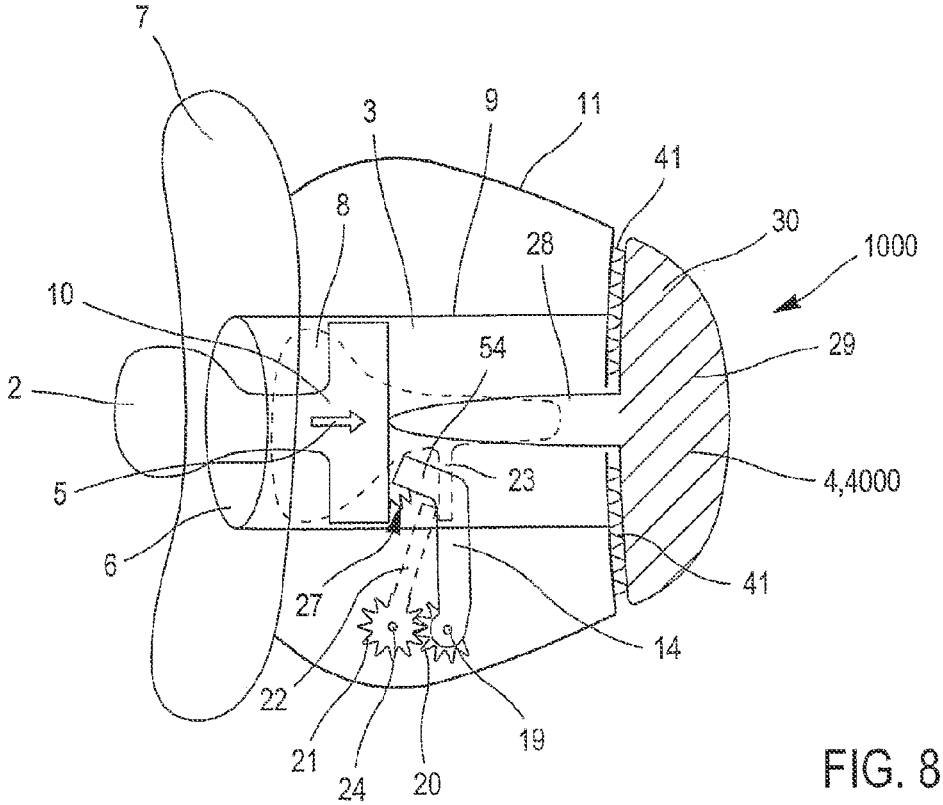
Figure 9:
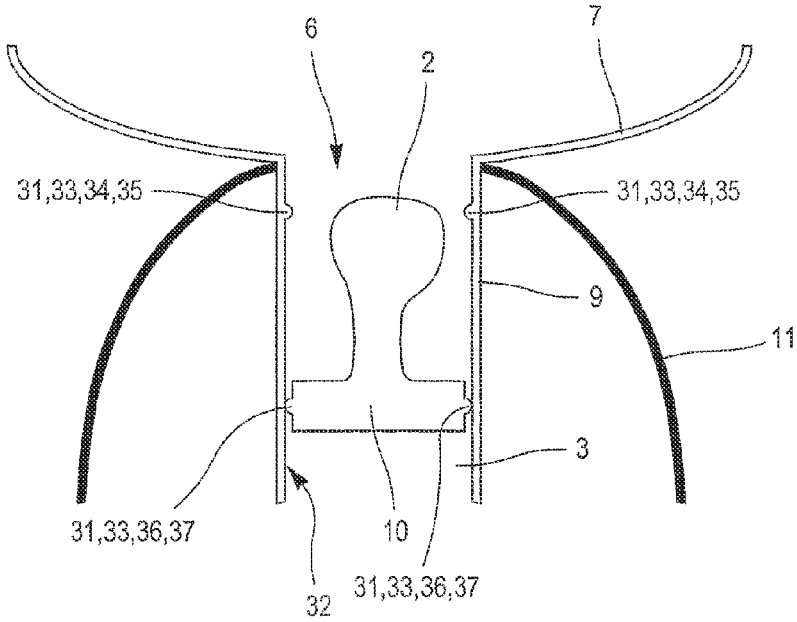
Figure 10:
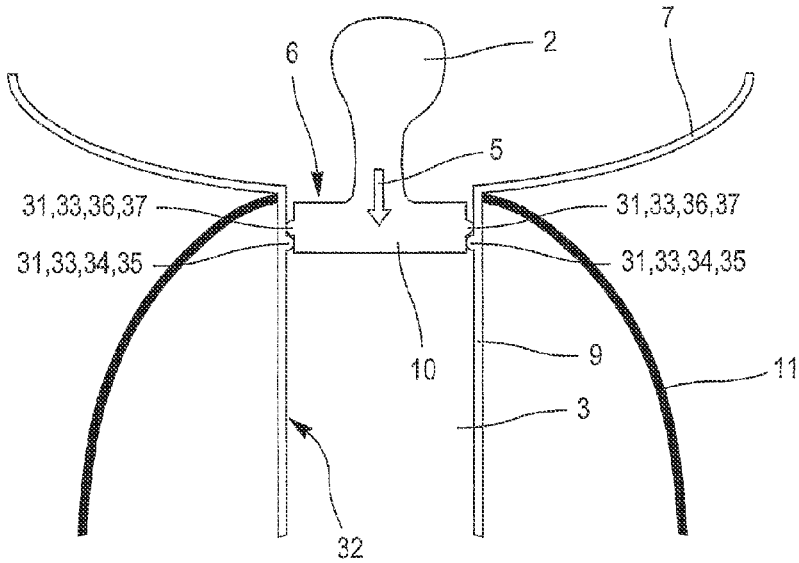
Figure 11:
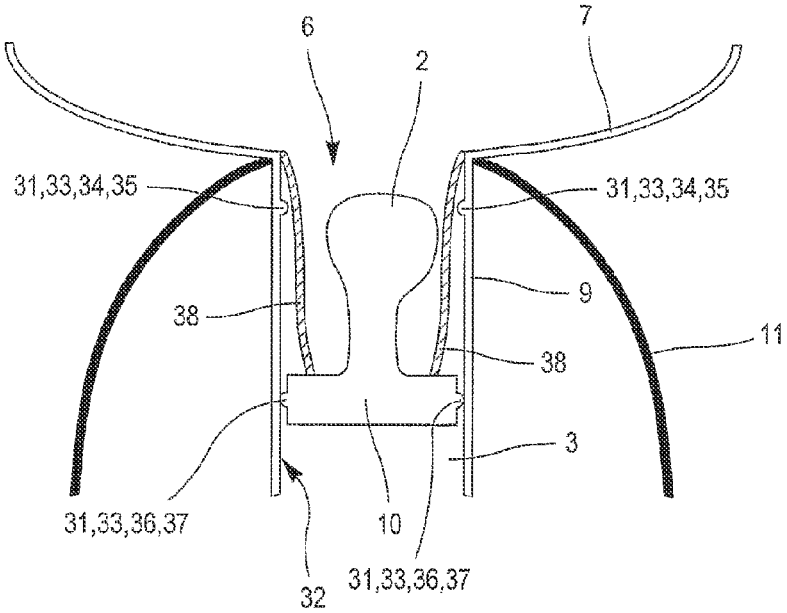
Figure 12:
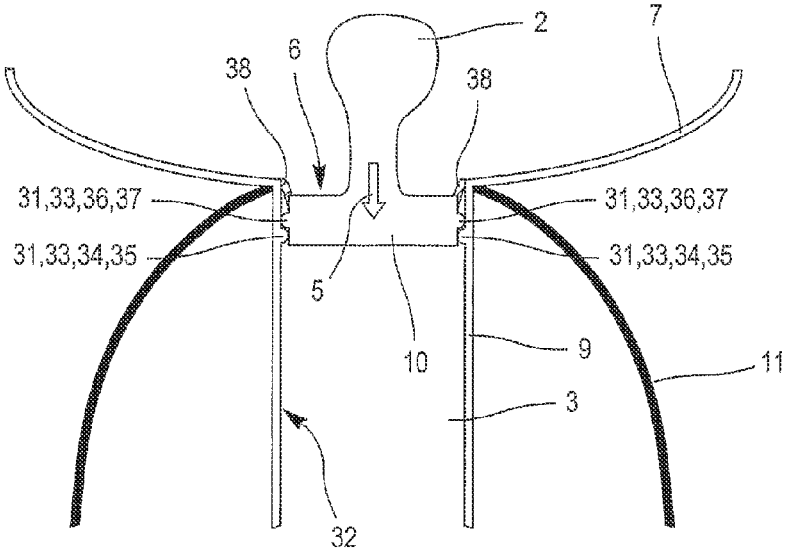
Figure 13:
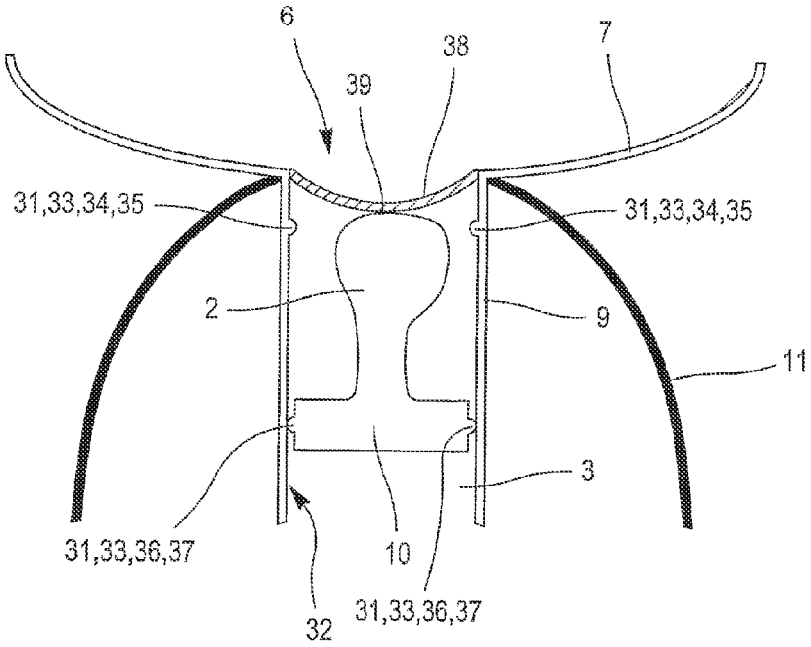
Figure 14:
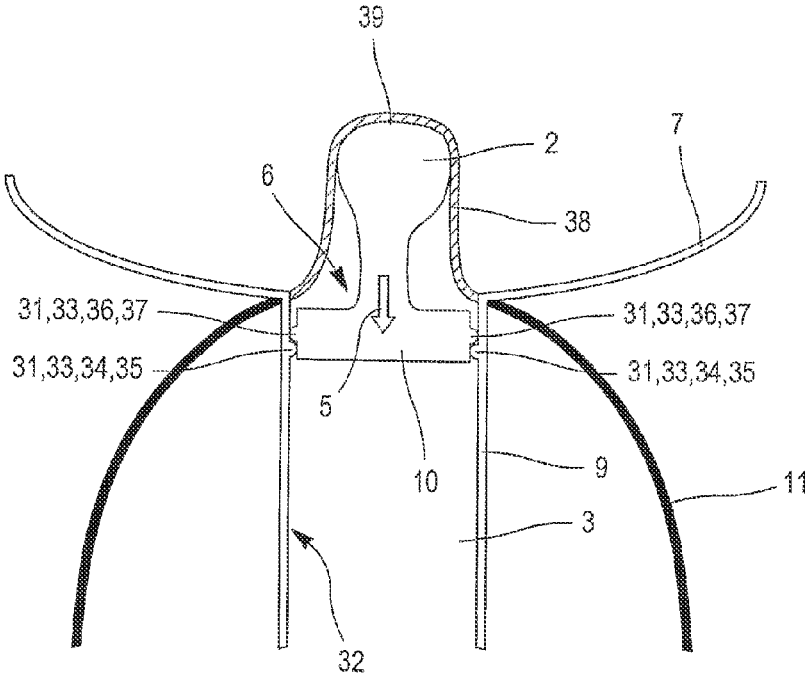

Other advantages and features of the invention will become apparent on reading the detailed description of implementations and embodiments which are in no way limitative, and the following attached drawings:

FIG. 1 is a top view of a first embodiment of a device for protecting a pacifier according to the invention, the pacifier being in a so-called internal position, FIG. 2 is a profile view of the first embodiment of a device according to the invention, corresponding to FIG. 1, FIG. 3 is a top view of the first embodiment of a device according to the invention, the pacifier being in a so-called external position, FIG. 4 is a profile view of the first embodiment of a device according to the invention, corresponding to FIG. 3, FIG. 5 is a top view of a second embodiment of a device for protecting a pacifier according to the invention, the pacifier being in a so-called internal position, FIG. 6 is a top view of the second embodiment of a device according to the invention, the pacifier being in a so-called external position, FIG. 7 is a top view of a third embodiment of a device for protecting a pacifier according to the invention, the pacifier being in a so-called internal position, FIG. 8 is a top view of the third embodiment of a device according to the invention, the pacifier being in a so-called external position, FIGS. 9, 11 and 13 illustrate different additional technical characteristics that can be implemented within any one of the first, second or third embodiments of a device according to the invention in FIGS. 1 to 8, the pacifier being in its so-called internal position, and FIGS. 10, 12 and 14 illustrate these different additional technical characteristics when the pacifier is in its so-called external position.

First of all a description will be given, with reference to FIGS. 1 to 4, of a first embodiment of a device 1 according to the invention, making it possible to protect a pacifier 2 and implementing a method according to the invention.

The device 1 comprises:

the pacifier 2, a housing 3 arranged to receive the pacifier, the pacifier 2 having an external position illustrated in FIGS. 3 and 4 in which the pacifier is situated outside the housing 3, the pacifier having an internal position illustrated in FIGS. 1 and 2 in which the pacifier is situated inside the housing 3, return means 4 arranged to exert a return force 5 on the pacifier 2, the return force 5 (shown only in FIGS. 3 and 4) pulling the pacifier 2 from its external position to its internal position, said means 4 for exerting the return force 5 comprising a spring 40, an orifice 6 linking the inside of the housing and the outside of the housing, said orifice being arranged to allow the passing of the pacifier from its internal position to its external position and the passing of the pacifier from its external position to its internal position, a support surface 7 for the mouth of a baby or young child, said surface 7 surrounding the orifice 6; in order to simplify FIGS. 2 and 4, the surface 7 is not illustrated in FIGS. 2 and 4, and means 8, 12 for closing the orifice when the pacifier is in its internal position, said closing means comprising a removable flap 8.

Seen from above in FIGS. 1 and 3, the flap 8 is substantially pear-shaped. In all the figures, the contour of the flap is shown in dotted lines.

The pacifier 2 is a protuberance intended to be sucked or suckled by a baby or young child, and is produced from a material preferably comprising rubber, latex and/or silicone.

In order to better distinguish the different elements of the device 1, the flap 8 is shown in dotted lines in the figures. The housing 3 is comprised in a hollow body 9 in which a tubular recess is formed. This hollow body is more precisely a cylindrical tube 9. The orifice 6 is situated at one of the two ends of this cylinder 9.

The pacifier 2 and a base 10 that holds the pacifier 2 and is integral with the pacifier 2 can be seen. The pacifier 2 is part of the device 1 intended to be sucked or suckled by a baby or young child while inside the mouth of this baby or child. During the suckling or sucking, the base 10 is a part that remains outside the child's mouth. In its external position (FIGS. 3 and 4) the pacifier 2 is situated completely outside the housing 3, and in its internal position (FIGS. 1 and 2) the pacifier is situated completely inside the housing 3. The spring 40 is linked to the pacifier 2 by means of the base 10. The base 10 remains at least partly inside the housing 3 when the pacifier 2 is in its internal position or in its external position. The orifice 6 is situated at one of the two ends of the cylindrical tube 9, and the spring 40 links the base 10 to the second end of the cylindrical tube 9.

The housing 3, the return means 4, the flap 8, the cylindrical tube 9, and the base 10 are situated inside a casing 11. The pacifier 2, the flap 8, and the base 10 can be moved with respect to the casing. The spring 40 comprises one point of attachment to one end of the cylinder 9 and another point of attachment to the base 10. The orifice 6, the housing 3 and the cylindrical tube 9 are integral with the casing 11. The surface 7 is situated outside the casing 11 and is integral with the casing 11. The orifice 6 is formed on one wall of the casing 11.

The flap 8 is linked to the casing 11 by a spring 12 situated inside the casing 11. In order to simplify the figures, the spring 12 is shown only in the profile FIGS. 2 and 4.

A more detailed description will now be given of the device 1 when the pacifier 2 is in its internal position, with reference to FIGS. 1 and 2. The internal position of the pacifier 2 coincides with a closing position of the flap 8. When the pacifier 2 is in its internal position, the device 1 is inert. The return means 4 exert a return force 5 on the pacifier 2, and this force 5 keeps the pacifier 2 in the housing 3 inside the cylinder 9. Similarly, the spring 12 exerts on the flap 8 a force 26 which keeps the flap 8 in a closing position, in which the flap 8 closes the orifice 6, prevents the pacifier moving from its internal position to its external position or from its external position to its internal position through the orifice 6, and thus prevents any dirt penetrating from outside the device 1 to the inside of the housing 3.

The device 1 also comprises means for manually actuating the passing of the pacifier from its internal position to its external position. These actuating means are arranged to push the pacifier 2 in a direction opposite to the return force 5 pulling on the pacifier 2. These actuating means comprise two levers 13, 14 arranged to push the pacifier 2 in a direction opposite to the return force 5. In order to simplify the figures, the levers 13 and 14 are shown only in the top views in FIGS. 1 and 3. Each lever 13, 14 is situated partly inside the casing 11 and partly outside the casing 11. The casing 11 comprises grooves 63, 64 (shown in dotted lines in FIGS. 1 and 3) through which the levers 13 and 14 pass. Each lever 13, 14 can pivot with respect to the casing 11. Each of these levers 13, 14 is linked to the casing 11 by a spring 15 or 16 respectively, situated inside the casing 11. In order to simplify the figures, the springs 15 and 16 are shown only in the top views in FIGS. 1 and 3. When the pacifier 2 is in its internal position, the spring 15 or 16 respectively keeps the lever 13 or 14 respectively in a position in which this lever 13 or 14 respectively exerts no force on the pacifier 2 or on the base 10. For each lever 13 or 14 respectively, one end 53 or 54 respectively of this lever is situated inside the housing 3 and is in contact with the base 10.

With reference to FIGS. 3 and 4, when a user presses on the levers 13 and 14 exerting a force 17, each lever 13 or 14 respectively pivots about a pivot 18 or 19 respectively, opposing a force 73 or 74 respectively exerted by the spring 15 or 16 respectively, so that each lever 13 or 14 respectively exerts on the base 10 and on the pacifier 2, a thrust force in the opposite direction to the direction of the return force 5, this thrust force causing the pacifier 2 to pass from its internal position to its external position. Each pivot 18, 19 is integral with the casing 11 and is situated inside the casing. When each lever 13 or 14 respectively exerts the thrust force, each end 53 or 54 respectively pushes the base 10 and the pacifier 2 and moves along the cylinder 9 towards the orifice 6 through a groove (not illustrated) situated along the cylinder 9. Thus, the passing of the pacifier from its internal position to its external position is manually actuated.

Moreover, the device 1 comprises means 20, 21, 22, 23, 24 for coupling the passing of the pacifier from its internal position to its external position by the actuating means 13, 14, 15, 16, 18, 19 with the retraction of the flap 8, the retraction of the flap 8 bringing the flap into an opening position in which the flap 8 is cleared from the orifice 6 so that the pacifier can pass from its internal position to its external position through the orifice 6. These coupling means comprise a toothed wheel 20, a toothed wheel 21, a lever 22, and a lever 23. These elements 20, 21, 22 and 23 are situated inside the casing 11. The contours of the levers 22 and 23 are shown in dotted lines.

The toothed wheel 20 is integral with the lever 14, is centred about the pivot 19 of the lever 14, and is free to pivot about the pivot 19. The toothed wheel 20 engages with the toothed wheel 21. The toothed wheel 21 is integral with the lever 22. The lever 22 is curved, passes round the housing 3 and the cylinder 9, and extends to reach and be in contact with the lever 23. The lever 23 is integral with the flap 8.

When a user presses on the levers 13 and 14 exerting the force 17, the lever 14 pivots about the pivot 19. The toothed wheel 20 then also pivots about the pivot 19, and causes the toothed wheel 21 to rotate about a pivot 24 in a direction opposite to the rotation of the toothed wheel 20. The pivot 24 is integral with the casing 11 and is situated inside the casing. The lever 22 being integral with the toothed wheel 21, the lever 22 also pivots about the pivot 24. When the lever 22 pivots, it pushes the lever 23 and the flap 8 so that the flap 8 slides along one wall of the casing 11 in rails (not shown) up to the opening position of the flap 8 while opposing the force 26 exerted by the spring 12 on the flap 8. In its opening position, the flap 8 is cleared from the orifice 6 so that the pacifier 2 can pass from its internal position to its external position through the orifice 6. Moreover, in its opening position, the flap 8 abuts against a stop 25 (shown only in the profile views in FIGS. 2 and 4) situated inside the casing 11 and integral with the casing 11. In order to allow the flap 8 to slide along one wall of the casing 11, the flap 8 is curved and has a curvature substantially equal to the curvature of this wall of the casing 11. Thus, the passing of the pacifier from its internal position to its external position is coupled with the opening of the orifice 6, this opening of the orifice 6 comprising the passing of the flap 8 from its closing position to its opening position.

FIGS. 3 and 4 show the device 1 when the pacifier 2 is in its external position, the external position of the pacifier 2 coinciding with the opening position of the flap 8. The device 1 cannot remain in this configuration without user intervention. In fact, when the pacifier 2 is in its external position and when the flap 8 is in its opening position:

the return means 4 exert a return force 5 on the pacifier 2, this return force 5 tending to bring the pacifier 2 from its external position back to its internal position via the orifice 6, the spring 12 exerts a return force 26 on the flap 8 which tends to bring the flap 8 from its opening position back to its closing position, and each spring 15 or 16 respectively exerts a return force 73 or 74 respectively on the lever 13 or 14 respectively which tends to bring the lever 13 or 14 respectively back into a position in which this lever no longer exerts any thrust force on the base 10 or on the pacifier 2.

Two solutions are possible for keeping the device 1 in the configuration shown in FIGS. 3 and 4:

a first solution consists of maintaining the force 17 exerted on the levers 13 and 14, and a second solution consists of putting the pacifier 2 into the mouth of a baby or young child; when the pacifier 2 is held in the mouth, the periphery of the mouth presses on the surface 7 and the baby or young child thus opposes the return force 5 exerted by the return means 4 on the base 10 (situated outside the mouth) and on the pacifier 2 (situated inside the mouth).

Moreover, the device 1 comprises means for coupling the passing of the pacifier from its external position to its internal position by the return means 4 with the closing of the orifice by the flap (i.e. with the passing of the flap 8 from its opening position to its closing position). In fact, when no force 17 is exerted on the levers 13 and 14 and when the pacifier 2 is not kept outside the housing 3 by the mouth of a baby or young child, the return means 4 exert a return force 5 on the pacifier 2, this return force 5 pulling the pacifier 2 from its external position to its internal position via the orifice 6. In its opening position, the flap 8 is cleared from the orifice 6 so that the pacifier can pass from its external position to its internal position through the orifice 6. In passing from its external position to its internal position, the pacifier presses on the ends 53, 54 of the levers 13, 14, which causes the toothed wheels 20, 21 and the lever 22 to pivot so that the lever 22 releases the strain that it is exerting on the lever 23. Once the pacifier 2 is in its internal position, the way is clear for the flap 8, which is brought back from its opening position to its closing position by the spring 12. Thus, the orifice is closed when the pacifier is in its internal position. The closing of the orifice is also coupled with the passing of the pacifier from its external position to its internal position, this closing of the orifice 6 comprising the passing of the flap 8 from its opening position to its closing position.

Thus, when the device 1 accidentally escapes from the mouth of the baby or young child and falls on the ground, the pacifier 2 automatically passes from its external position to its internal position and the flap 8 automatically passes from its opening position to its closing position, so that once the device reaches the ground, the pacifier 2 is isolated from the external environment by the flap 8 and no dirt originating from the ground can be deposited on the pacifier 2. The device 1 thus makes it possible to protect the pacifier against dirt, germs, and microbes, and therefore makes it possible to improve the hygiene of the pacifier 2.

A description will now be given, with reference to FIGS. 5 and 6, of a second embodiment of a device 100 according to the invention implementing the method according to the invention. The device 100 is described only for its differences with respect to the first embodiment 1 in FIGS. 1 to 4. In particular, references 2 to 26, 53, 54, 63, 64, 73 and 74 will not be described again.

The second embodiment differs from the first embodiment in that the return means 4 do not comprise a spring 40, but comprise a space 400 in which a vacuum is created.

By vacuum is meant a partial or total vacuum, having a pressure less than the pressure surrounding the pacifier 2, i.e. having a pressure typically less than atmospheric pressure.

The orifice 6 is situated at one of the two ends of the cylindrical tube 9, and the space 400 is situated at the second end of the cylindrical tube 9. This space 400 is delimited by walls of the cylindrical tube 9 and by one wall of the base 10 which moves along the cylindrical tube 9 when the pacifier 2 passes from its internal position to its external position or from its external position to its internal position. Thus, the volume of the space 400 increases when the pacifier passes from its internal position to its external position, and the volume of the space 400 diminishes when the pacifier passes from its external position to its internal position. This space 400 is isolated so that matter cannot enter or leave this space 400. Thus, this space behaves like a spring that exerts on the base 10 and on the pacifier 2 a return force 5 that is proportional to the volume of this space 400 and which brings the pacifier 2 back from its external position to its internal position.

A description will now be given, with reference to FIGS. 7 and 8, of a third embodiment of a device 1000 according to the invention implementing the method according to the invention. The device 1000 is described only for its differences with respect to the first embodiment 1 in FIGS. 1 to 4. In particular, references 2 to 12, 14, 19 to 26 and 54 will not be described again.

The third embodiment differs from the first embodiment in that the return means 4 do not comprise a spring 40, but comprise a flexible and deformable pocket 4000 comprising an envelope filled with fluid, more precisely with gas, more precisely with air at atmospheric pressure. The pocket 4000 is hermetically sealed, i.e. the fluid that it contains cannot escape from it.

Moreover, the means for manually actuating the passing of the pacifier from its internal position to its external position comprise this deformable pocket which is arranged to exert on the base 10 and the pacifier 2, when the pocket is actuated, pressure opposed to the force 5.

Thus, within the means 4000, the functions of returning the pacifier from its external position to its internal position and manual actuation of the passing of the pacifier from its internal position to its external position are combined.

The pocket 4000 comprises a first part 28 integral with the pacifier 2 and with the base 10 and situated inside the casing 11. For this, one end 28 of the first part 28 of the pocket 4000 is fixed by gluing to the base 10.

The pocket comprises a second part 29 situated outside the casing 11 so that this part 29 protrudes or emerges with respect to the remainder of the device 1000 and is therefore accessible to a user. This second part 29 is integral with the casing 11 and housing 3 by means of glue 41 arranged on the outside of the casing 11.

The pocket 4000 is a plastic pocket produced by moulding, the most stable shape of which, i.e. the shape corresponding to the "shape memory" of the moulded plastic forming the envelope of the pocket, is illustrated in FIG. 7 and corresponds to the case where the pacifier is in its internal position. For this most stable shape, the majority of the volume of the pocket is constituted by the part 29 situated outside the casing.

The pocket 4000 is deformable. When a user actuates this pocket by exerting pressure 30 on the part 29, for example by pinching so as to reduce the volume of the part 29, the volume of the part 28 situated inside the casing and inside the housing 3 increases so that the part 28 of the pocket 4000 pushes the base 10 and the pacifier 2 from its internal position to its external position in the opposite direction to the force 5, as illustrated in FIG. 8. In FIG. 8, the pinching force 30 is symbolized by hatching. This pinching force 30 flattens the part 29 perpendicular to the plane of FIG. 8, so that seen from above as illustrated in FIG. 8 the part 29 does not change in silhouette, but in a profile view (not illustrated), the thickness of the part 29 would be seen to be reduced.

When the pacifier 2 is in its external position, the pocket 4000 is in an unstable position in which the majority of the volume of the pocket is constituted by the part 28 situated inside the casing. This unstable position of the pocket and the external position of the pacifier are maintained:

either by the pressure 30 of the user on the pocket 4000, or by a suction force exerted on the pacifier 2 by a user such as a child.

The device 1000 cannot remain in the configuration illustrated in FIG. 8 in which the pacifier is in its external position without user intervention. In fact:

when the pacifier 2 is in its external position, and when no force 30 is exerted on the part 29 of the pocket 4000 and when the pacifier 2 is not kept outside the housing 3 by sucking of the pacifier by the mouth of a user, the return means 4, 4000 exert a return force 5 on the pacifier 2, this return force 5 pulling and bringing the pacifier 2 from its external position back to its internal position.

Thus, as for the previous embodiments of the device, when the device 1000 accidentally escapes from the mouth of a baby or young child and falls on the ground, the pacifier 2 automatically passes from its external position to its internal position due to this return force 5, and the flap 8 passes automatically from its opening position to its closing position, so that once the device reaches the ground, the pacifier 2 is protected from the external environment by the housing and no dirt originating from the ground can be deposited on the pacifier 2.

Moreover, the device 1000 does not comprise the lever 13, the pivot 18, or the springs 15 and 16. Unlike the first embodiment of a device 1, the lever 14 does not serve to manually actuate the passing of the pacifier from its internal position to its external position, but only:

to couple the passing of the pacifier from its internal position to its external position with the passing of the flap 8 from its closing position to its opening position, and to couple the passing of the pacifier from its external position to its internal position with the passing of the flap 8 from its opening position to its closing position.

The device 1000 does not comprise the grooves 63, 64, so that the lever 14 does not leave the casing 11. The end 54 of the lever is not directly in contact with the base 10 but is linked to the base 10 by linking means 27 typically comprising a pivot and/or (as illustrated in FIGS. 7 and 8) a spring. Thus, when the pacifier passes from its internal position to its external position or from its external position to its internal position respectively, the base 10 carries along, in its translation movement, the end 54 of the lever 14, which causes the rotation of the lever about its pivot 19 and causes the passing of the flap 8 from its closing position to its opening position or from its opening position to its closing position respectively, by means of the spring 12 (not illustrated), the wheels 20, 21, the levers 22, 23, and the pivot 24 as explained previously with reference to FIGS. 1 to 4.

It is noted that in the first, second and third embodiments of the device according to the invention previously described, the return means 4 are arranged, as soon as the pacifier is not in its internal position, to constantly exert a return force 5 on the pacifier 2, this return force 5 pulling the pacifier to its internal position and tending to bring the pacifier 2 back to its internal position by a translation movement. In particular, when the pacifier is in its external position, the return means 4 constantly exert a return force 5 on the pacifier 2, this return force 5 pulling the pacifier from its external position to its internal position and tending to bring the pacifier 2 from its external position back to its internal position by a translation movement passing through the orifice 6.

Moreover, in the first, second and third embodiments of the device according to the invention previously described, it is noted that the housing 3 for the pacifier is present and exists in an identical state having a constant form and volume, both when the pacifier is in its internal position and when the pacifier is in its external position. The housing 3 like the tube 9 is rigid, non-deformable and in particular non-pliable. Thus, if the device according to the invention falls on the ground when the pacifier is in its internal position inside the housing 3, the impact is not likely to crush the tube 9 and deform the housing 3 and reduce the size of the housing 3 and bring the pacifier 2 into contact with the ground at least momentarily. Moreover, the housing 3 is protected inside the casing 11 which is itself also rigid and non-deformable.

A description will now be given, with reference to FIGS. 9 and 10, of the means of relief implemented in the first 1, second 100 and third 1000 embodiments of a device according to the invention. In particular, references 2 to 7 and 9 to 11 will not be described again. FIGS. 9 and 10 are profile cross-sectional views of only a part of the device 1, 100, or 1000 comprising the pacifier 2. In particular, the return means 4 (spring 40, space 400, deformable pocket 4000) are not illustrated.

The relief means 31 are arranged to reduce the return force 5 when the pacifier is in its external position without however cancelling out this return force, so that the suction force necessary to keep the pacifier in its external position by sucking the pacifier is reduced. The user sucking the pacifier 2 in the external position is thus relieved in their effort to keep the pacifier in the external position by sucking. However, as the relief means do not cancel out the force 5, the return means 4 still continuously exert a return force pulling the pacifier from its external position to its internal position, so that:

these relief means are not sufficient by themselves to lock the pacifier in its external position and prevent the return of the pacifier to its internal position, and when the device 1, 100 or 1000 accidentally escapes from the mouth of a baby or young child and falls on the ground, the pacifier 2 automatically passes from its external position to its internal position.

Moreover, the braking means are arranged so as not to reduce the return force when the pacifier 2 is not in its external position, in particular when the pacifier is in an intermediate position between its internal position and its external position.

When the pacifier passes from its external position to its internal position or from its internal position to its external position, the pacifier 2 and the base 10 slide inside the hollow tubular body 9, along an internal wall 32 of this body 9. The relief means consist of braking means 33, arranged to brake the pacifier 2 and the base 10 when the pacifier is in its external position, but not to brake a movement of the pacifier when the base 10 and the pacifier 2 move inside the tube 9, from the external position to the internal position of the pacifier, after the pacifier has left its external position. The braking means comprise:

a first part 34 situated close to the orifice 6 (i.e. closer to the orifice 6 than to the second end of the tube 9 opposite the orifice 6), this first part 34 comprising at least one protuberance 35 formed on and integral with the inner wall 32 of the tube 9 inside which the pacifier 2 is arranged to move between its internal position and its external position, and optionally but preferentially, a second part 36 integral with the pacifier 2 and with the base 10, this second part comprising at least one protuberance 37.

Each of the protuberances 35 and 37 has a cylindrical rotational symmetry about the axis of the tube 9. As illustrated in FIGS. 9 and 10, the base 10 has, at the level of the at least one protuberance 37, a diameter greater than the diameter of the tube 9 at the level of the at least one protuberance 35. The tube 9 being made of plastic and the base 10 made of plastic or rubber, the at least one protuberance 37 can clear the at least one protuberance 35 in either direction (internal position of the pacifier to its external position or vice-versa) by mechanical clearance or by plastic or elastic deformation of the at least one protuberance 37 and/or of the at least one protuberance 35.

The protuberances 35 and 37 are designed so that, when the pacifier is in its external position as illustrated in FIG. 10, the return means pulling the pacifier from its external position to its internal position, the at least one protuberance 37 presses on the at least one protuberance 35 so that the force 5 is reduced and the user sucking the pacifier is relieved. The braking means 33 brake the pacifier when it seeks to leave its external position.

Moreover, protuberances 35 and 37 are designed so that, after the pacifier has left its external position as illustrated in FIG. 9, the at least one protuberance 37 moves inside the body or tube 9 without meeting or coming into contact with the at least one protuberance 35, so as not to brake the movement of the pacifier inside the tube 9 from its external position to its internal position.

Moreover, in the first, second and third embodiments of the device according to the invention previously described, the surface 7 and the body or tube 9 are integral and formed by a single piece made of plastic obtained by moulding.

A description will now be given, with reference to FIGS. 11 and 12, of a first variant of the first 1, second 100 and third 1000 embodiments of a device according to the invention. In particular, references 2 to 7, 9 to 11 and 31 to 37 will not be described again. FIGS. 11 and 12 are profile cross-sectional views of only a part of the device 1, 100, or 1000 comprising the pacifier 2. In particular, the return means 4 (spring 40, space 400, deformable pocket 4000) are not illustrated.

In this first variant, the device according to the invention does not comprise the flap 8, the levers 23, 22, the wheel 21, but comprises a membrane or film 38.

The orifice 6 is delimited by a circular rigid rim.

The membrane 38 is integral with the rim of the orifice 6, and is moreover integral with the pacifier, so as to completely block off the orifice 6, and so that the membrane links the rim of the orifice 6 to the pacifier 2.

When it is flattened, the membrane 38 is in the shape of a disc with a hole through its centre.

The outer perimeter of the membrane is integral with the rim of the orifice 6 and the inner perimeter of the hole formed in the centre of the membrane 38 is integral with the base 10 and with the pacifier 2 so that the membrane 38 and the pacifier 2 both cover the whole of the surface of the orifice 6, the membrane 38 and the pacifier 2 completely blocking off the orifice so that there is no gap:

on the one hand between the rim of the orifice 6 and the membrane 38 i.e. there is no gap between the surface 7 or the casing 11 and the membrane 38, and on the other hand between the membrane 38 and the pacifier 2 or the base 10.

Thus, no dust or dirt can get inside the casing 11 for example along the tube 9, which guarantees optimum hygiene of the device according to the invention. By comparison, in the case of the first embodiment of a device according to the invention without a membrane 38 as illustrated in FIG. 1, bacteria and other dirt are capable of penetrating and developing inside the device according to the invention in places that are difficult to access and therefore difficult to clean, such as for example on the wall of the tube 9, the different springs, the toothed wheels 20, 21, etc.

The membrane 38 is integral with the base 10 and with the pacifier 2, and the membrane 38 and the pacifier are contiguous at the base 10 so that, when the pacifier is in the external position, the pacifier 2 is not covered by the membrane 38, is visible from the outside of the device, and a user sucking the pacifier is in contact with the pacifier 2.

The membrane 38 is a stretchable latex membrane.

When the pacifier is in its internal position illustrated in FIG. 11, the membrane 38 is stretched. Moreover, when the pacifier is in its internal position illustrated in FIG. 11, the surface that was in contact with the mouth of a user sucking the pacifier, i.e. the pacifier 2, is situated inside the housing 3 and is therefore protected if the pacifier falls on the ground.

When the pacifier is in its external position illustrated in FIG. 12, the membrane 38 is at rest i.e. not stretched. A user sucking the pacifier is in contact with the pacifier 38. In this position, it is simple to clean the parts of the device according to the invention that are accessible to the mouth of a user, for example by passing the pacifier 2, the surface 7 and the membrane 38 under water from a tap, without the risk of introducing moisture inside the device according to the invention.

A description will now be given, with reference to FIGS. 13 and 14, of a second variant of the first 1, second 100 and third 1000 embodiments of a device according to the invention only for its differences with respect to the first variant of FIGS. 11 and 12. In particular, references 2 to 7, 9 to 11 and 31 to 37 will not be described again. FIGS. 13 and 14 are profile cross-sectional views of only a part of the device 1, 100, or 1000 comprising the pacifier 2. In particular, the return means 4 (spring 40, space 400, deformable pocket 4000) are not illustrated.

In this second variant, the device according to the invention does not comprise the flap 8, the levers 23, 22, the wheel 21, but comprises a membrane or film 38.

The orifice 6 is delimited by a circular rigid rim.

The membrane 38 is integral with the rim of the orifice 6, and is moreover integral with the pacifier, so as to completely block off the orifice 6, and so that the membrane links the rim of the orifice 6 to the pacifier 2.

The membrane 38 by itself covers the whole of the surface of the orifice 6. When it is flattened, the membrane 38 has the shape of a complete disc. The circular contour of the membrane is integral with the rim of the orifice 6 so that the membrane completely blocks off the orifice 6 by itself, so there is no gap between the rim of the orifice 6 and the membrane i.e. there is no gap between the surface 7 or the casing 11 and the membrane.

Thus, no dust or dirt can get inside the casing 11 for example along the tube 9, which guarantees optimum hygiene of the device according to the invention. By comparison, in the case of the first embodiment of a device according to the invention without a membrane 38 as illustrated in FIG. 1, bacteria and other dirt are capable of penetrating and developing inside the device according to the invention in places that are difficult to access and therefore difficult to clean, such as for example on the wall of the tube 9, the different springs, the toothed wheels 20, 21, etc.

The membrane 38 is integral with the end 39 of the pacifier directed towards the outside of the device according to the invention so that, when the pacifier is in the external position, the pacifier 2 is covered by the membrane 38 and a user sucking the pacifier is not directly in contact with the pacifier 2 but sucks the pacifier 2 with the membrane 38 as an intermediate element.

The membrane 38 is a stretchable latex membrane.

When the pacifier is in its internal position illustrated in FIG. 13, the membrane 38 is at rest i.e. not stretched. Moreover, when the pacifier is in its internal position illustrated in FIG. 13, the surface that has been in contact with the mouth of a user sucking the pacifier, i.e. the surface of the membrane 38 visible from the outside of the device, is situated inside the housing 3 and is therefore protected if the pacifier falls on the ground.

When the pacifier is in its external position illustrated in FIG. 14, the membrane 38 is stretched. A user sucking the pacifier is not in contact with the pacifier 38 but sucks the pacifier 2 via the membrane 38. This user's mouth is then in contact with the membrane, which lies against the pacifier, moulding itself to its shape.

With respect to the first variant in FIGS. 11 and 12, it is noted that the surface in contact with the mouth of a user sucking the pacifier is particularly easy to clean, whether the pacifier is in its internal or external position, as this surface is the surface of the membrane 38 visible from the outside of the device according to the invention and is a simple smooth surface without abrupt shapes in particular without the angle where the base 10 joins the pacifier 2. By cleaning only the membrane 38, the surface normally in contact with a user's mouth is cleaned, without the risk of introducing moisture inside the device according to the invention.

Finally, in a third variant of the first 1, second 100 and third 1000 embodiments of a device according to the invention, the casing 11 of this device according to the invention is provided with several small holes linking the outside of the device according to the invention with the housing 3 so that moisture stored in the housing 3 following sucking of the pacifier 2 can be discharged from the device according to the invention.

Of course, the invention is not limited to the examples that have just been described and numerous adjustments can be made to these examples without exceeding the scope of the invention.

For example, in a variant, the at least one protuberance 35 and/or the at least one protuberance 37 comprises several protuberances in the form of a portion of a sphere distributed along a closed, preferably circular line centred on the axis of the tube 9.

Moreover, the different means 40, 400, 4000 for exerting a return force can be combined with each other. For example, an embodiment of a device according to the invention can comprise both a spring 40 and a pocket 4000 as return means 4.

The invention claimed is:

1. Device (1, 100) for protecting a pacifier (2), comprising:

a housing (3) for the pacifier, the pacifier having an external position in which said pacifier is situated outside the housing, the pacifier having an internal position in which said pacifier is situated inside the housing, an orifice (6) allowing the pacifier (2) to pass from the internal position to the external position and from the external position to the internal position, and means (4, 40, 400) for exerting a return force (5) on the pacifier, the return force pulling the pacifier from the external position to the internal position, wherein the housing (3) and the means for exerting the return force (4, 40, 400) are situated inside a casing (11).

2. Device according to claim 1, wherein the means (4, 40, 400) for exerting the return force are arranged to pull the pacifier so that without user intervention the device cannot remain in a configuration in which the pacifier is in the external position.

3. Device according to claim 1, wherein the external position the pacifier is situated completely outside the housing, and in the internal position the pacifier is situated completely inside the housing.

4. Device according to claim 1, further comprising means (8, 12) for closing the orifice when the pacifier is in the internal position.

5. Device according to claim 4, wherein the closing means comprise a removable flap (8).

6. Device according to claim 4, further comprising means (20, 21, 22, 23, 24) for coupling the closing of the orifice by the closing means with the passing of the pacifier from the external position to the internal position.

7. Device according to claim 1, further comprising means (13, 14, 18, 19, 53, 54) for actuating the passing of the pacifier from the internal position to the external position, arranged to push the pacifier in a direction opposite to the return force (5).

8. Device according to claim 7, wherein the actuating means comprise at least one lever in order to push the pacifier in a direction opposite to the return force (5).

9. Device according to claim 7, wherein the actuating means comprise a deformable pocket (4000) a first part of which (28) is integral with the pacifier (2) and a second emerging part (29) of which is accessible to a user.

10. Device according to claim 9, wherein the means for exerting the return force comprise the deformable pocket.

11. Device according to claim 7, further comprising means (20, 21, 22, 23, 24) for coupling the passing of the pacifier from the internal position to the external position by the actuating means with the opening of the orifice.

12. Device according to claim 1, wherein the means for exerting the return force comprise a spring (40).

13. Device according to claim 1, wherein the means for exerting the return force comprise a space (400) in which a vacuum is created.

14. Device according to claim 1, further comprising a support surface (7) for a mouth, said support surface surrounding the orifice.

15. Device according to claim 14 wherein the support surface (7) is situated outside the casing (11) and is integral with the casing (11).

16. Device according to claim 1, wherein the pacifier is inert when the pacifier is in the internal position.

17. Device according to claim 1, wherein the housing is comprised in a cylindrical tube (9), the orifice being situated at one of the two ends of said cylindrical tube.

18. Device according to claim 1, wherein the pacifier (2) can move with respect to the casing (11), and the orifice (6) and the housing (3) are integral with the casing (11).

19. Device according to claim 1, wherein the orifice (6) is formed on one wall of the casing (11).

20. Device according to claim 1, further comprising braking means (35, 37) arranged to reduce the return force (5) when the pacifier is in the external position without cancelling out the return force.

21. Device according to claim 20, wherein the braking means comprise at least one protuberance (37) integral with the pacifier and/or at least one protuberance (35) integral with a body (9) inside which the pacifier is arranged to move between the internal position and the external position.

22. Device according to claim 1, further comprising a stretchable membrane (38) integral with the pacifier (2) and a rim of the orifice (6) so as to block off the orifice (6).

23. Device according to claim 22, wherein the rim of the orifice (6) and the membrane (38) are integral so that the membrane (38) by itself blocks off the orifice with no gap between the rim of the orifice (6) and the membrane (38), and so that when the pacifier (2) is in the external position, the pacifier is covered by the membrane (38).

24. Device according to claim 22, wherein the rim of the orifice (6), the membrane (38) and the pacifier (2) are integral so that the membrane (38) and the pacifier (2) block off the orifice with no gap between the rim of the orifice (6) and the membrane (38) and with no gap between the membrane (38)

and the pacifier, and so that when the pacifier (2) is in the external position, the pacifier is not covered by the membrane (38).

25. Method for protecting a pacifier comprising a housing (3) for the pacifier, the pacifier having an external position in which said pacifier is situated outside the housing, the pacifier having an internal position in which said pacifier is situated inside the housing, an orifice (6) allowing the pacifier (2) to pass from the internal position to the external position and from the external position to the internal position, and means (4, 40, 400) for exerting a return force (5) on the pacifier, the return force pulling the pacifier from the external position to the internal position, the housing (3) and the means for exerting the return force (4, 40, 400) being situated inside a casing (11), said method comprising:

exerting the return force on the pacifier such that the return force pulls the pacifier from the external position to the internal position.

26. Method according to claim 25, wherein the return force pulls the pacifier so that without user intervention the device cannot remain in a configuration in which the pacifier is in the external position.

27. Method according to claim 25, wherein the orifice (6) is surrounded by a support surface (7) for a mouth.

28. Method according to claim 27, further comprising closing of the orifice when the pacifier is in the internal position.

29. Method according to claim 28, further comprising coupling of the closing of the orifice with the passing of the pacifier from the external position to the internal position.

30. Method according to claim 27, further comprising actuation of the passing of the pacifier from the internal position to the external position, pushing the pacifier in a direction opposite to the return force (5).

31. Method according to claim 30, wherein the actuation comprises the actuation of a lever (14) in order to push the pacifier in a direction opposite to the return force (5).

32. Method according to claim 30, wherein the actuation comprises the actuation of a deformable pocket (4000) a first part of which (28) is integral with the pacifier (2) and a second emerging part (29) of which is accessible to a user, said actuation comprising the exertion of pressure (30) on the second part (29) of the pocket (4000).

33. Method according to claim 32, wherein the return force (5) is exerted by the deformable pocket (4000).

34. Method according to claim 30, further comprising coupling of the passing of the pacifier from the internal position to the external position with the opening of the orifice.

35. Method according to claim 27, further comprising reduction, by braking means (35, 37), of the return force (5) when the pacifier is in the external position without cancelling out the return force.

36. Method according to claim 27, further comprising obstruction of the orifice (6) by a stretchable membrane (38) integral with a rim of the orifice (6) and the pacifier (2).

* * * * *